United States Patent [19]

Bergeron

[11] 4,424,909

[45] Jan. 10, 1984

[54] CRANE BOOM WARNING ACTUATOR

[75] Inventor: Ned A. Bergeron, Houma, La.

[73] Assignee: B.W.B. Controls, Inc., Houma, La.

[21] Appl. No.: 266,112

[22] Filed: May 21, 1981

[51] Int. Cl.[3] ..... B66D 1/56

[52] U.S. Cl. ..... 212/153; 212/152; 254/269

[58] Field of Search ..... 212/149, 150, 152, 153, 212/154, 155, 157, 158; 116/68; 251/324; 254/269

[56] References Cited

U.S. PATENT DOCUMENTS

| | | | |
|---|---|---|---|
| 1,369,147 | 2/1921 | Valls | 254/269 |
| 1,743,758 | 1/1930 | Cobb | 251/324 |
| 2,840,244 | 6/1958 | Thomas, Jr. | 254/269 |
| 3,814,265 | 6/1974 | Miller | 212/149 |
| 3,924,752 | 12/1975 | Hoofnagle | 212/153 |
| 3,969,714 | 7/1976 | Greer | 212/152 |
| 4,131,078 | 12/1978 | Morrow | 212/153 |
| 4,135,632 | 1/1979 | Berkel | 212/153 |
| 4,170,308 | 10/1979 | Rogers | 212/149 |
| 4,345,539 | 8/1982 | Williams | 116/68 |

FOREIGN PATENT DOCUMENTS

| | | | |
|---|---|---|---|
| 2523690 | 12/1976 | Fed. Rep. of Germany | 212/153 |

*Primary Examiner*—Trygve M. Blix
*Assistant Examiner*—Thomas J. Brahan
*Attorney, Agent, or Firm*—Bode & Smith

[57] ABSTRACT

A fluid pressure-activated warning system for a crane comprising a plurality of signal device actuators each further comprising a valve spool, shiftable in response to a dangerous condition, and adapted to permit the emission of an alarm on the occurrance of such dangerous condition.

8 Claims, 3 Drawing Figures

CRANE BOOM WARNING ACTUATOR

BACKGROUND OF THE INVENTION

The operation of cranes can produce conditions dangerous to both operators and persons or property nearby. The condition guarded against by the instant invention would result from the crane tipping over. Such event might occur should the crane boom approach vertical past a critical angle or should a load strike the boom. There have, therefore, been prior developments designed to warn the operator and other parties on the existance of a dangerous or near-dangerous condition. The closest art to the present invention, known to applicant, is that taught by U.S. Pat. No. 3,924,752 assigned to the same assignee as is this application. Such reference emits an audible signal if a load too closely approaches the boom, or if the boom reaches a critical angle. While this invention accomplishes the same goal, it does so in a greatly simplified manner. It further eliminates the need for exterior springs which might fail or become contaminated.

SUMMARY OF THE INVENTION

A source of pressurized fluid, normally pneumatic, provides such fluid to one or more of either a generally horizontally or vertically positioned valve. Each such valve has a shiftable spool, a fluid inlet as well as outlet. When the boom, or a load carried thereby, approaches such valve, it causes shifting of the spool, opening communication between such inlet and outlet. The latter opening communicates with a pressure activated signalling device, preferably of audible nature.

DESCRIPTION OF A PREFERRED EMBODIMENT

Figure 1:
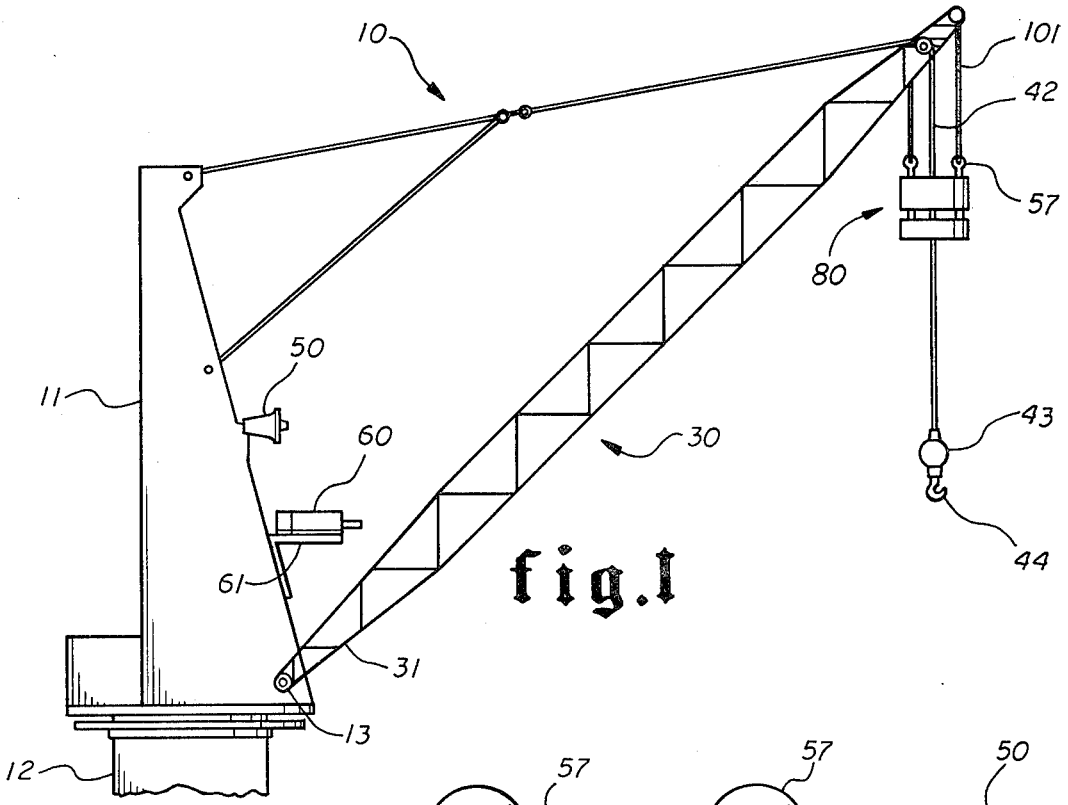
FIG. 1 is a side view of a generalized crane, having both a boom and a line actuator positioned thereon.

Looking first at FIG. 1, a generalized crane 10 is depicted, having a cab 11 resting on a turntable 12 which in turn might rest on a movable tractor or carriage (not shown) or on a fixed support (also not shown). Said cab also provides as at 13, a pivotal support for one end 31 of a crane boom, generally illustrated by the numeral 30. The cab may also provide support for a signalling device, such a horn 50 and for a fixed boom actuator 60, the latter member being shown as being fixed to flange or mounting bracket 61, and it to the cab. In addition, the cab may carry a source of fluid under pressure (not illustrated in FIG. 1) and conduits linking such source and horn to the actuator hereafter described. Also shown in FIG. 1 are a plurality of boom supporting cables, a load line 42, having ball 43 and hook 44 extending therefrom, and a line actuator 80.

Figure 3:
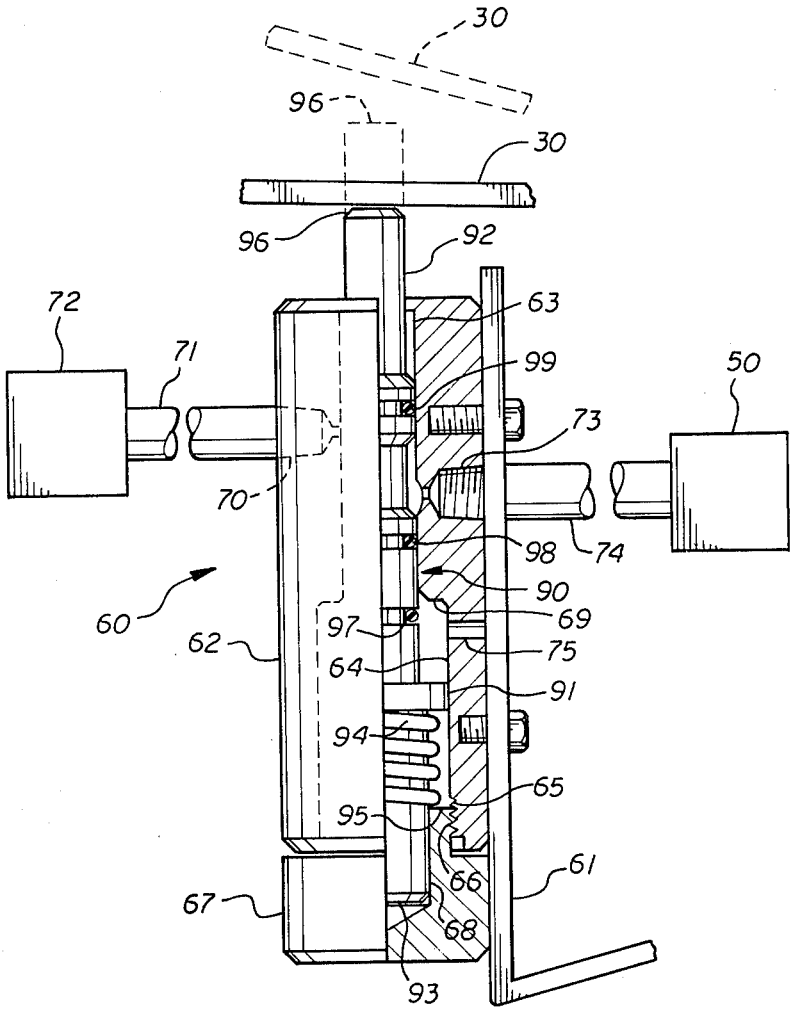
FIG. 3 is also a vertical quarter section, but this time through the boom actuator.

Look now to the FIG. 3 illustration of boom actuator 60. This actuator, as shown is in the open or warning position because of the proximity of boom 30 thereto. The phantom line position of boom 30 and actuator stem 92 and end 96 illustrates the blocking or non-danger position. Boom actuator 60 includes a unitary cylindrical housing 62 having an axial bore 63 and communicating axial counter bore 64 extending therethrough.

One end of counterbore 64 has female threads 65 to matingly receive male threads 66 of cap 67. Such cap includes a tapped bore 68 for receiving one end of the valve body later described. The other end of counterbore 64 is joined to bore 63 by shoulder 69. Housing 62 also includes a supply pressure inlet 70, connected by conduit 71 to source 72, and in pressure communicating relationship with bore 63. The housing further includes supply pressure outlet 73, also communicating with bore 63, but also, by conduit 74, with horn 50. Said outlet would be displaced from bracket 61. Exhaust passageway 75 provides a pressure relief within the upper reaches of counterbore 64. Slidably disposed within bore 63, counterbore 64 and cap bore 68 is a valve body or spool 90. Such valve body includes piston 91 with oppositely extending and depending stems 92 and 93, respectively. Compression spring 94 encircles stem 93 and engages one side of piston 91 and housing shoulder 95, thereby urging or biasing the valve body 90 away from cap 67. Intermediate the juncture of stem 92 with piston 91 and such stem's boom-engaging end 96, a plurality of O-rings 97, 98 and 99 are provided.

The operation of such boom actuator is as follows. Pressurized fluid is provided inlet 70 by source 72. When boom 30 moves too close toward vertical, it, or a plate provided it, contacts stem end 96 moving valve body 90, against the urging or biasing of spring 94, toward the position illustrated by FIG. 3. Such action establishes fluid communication via bore 63 between inlet 70 and outlet 73, thereby providing pressure to activate a signalling device, such as a horn 50. When such boom is caused to move to the phantom line position of FIG. 3, spring 94 urges the valve body 90 to its phantom line position. At this time, O-ring seal 98 blocks communication between the inlet 70 and outlet 73, causing the horn 50 to cease sounding. Pressure within conduit 74 could be bled, if desired.

Figure 2:
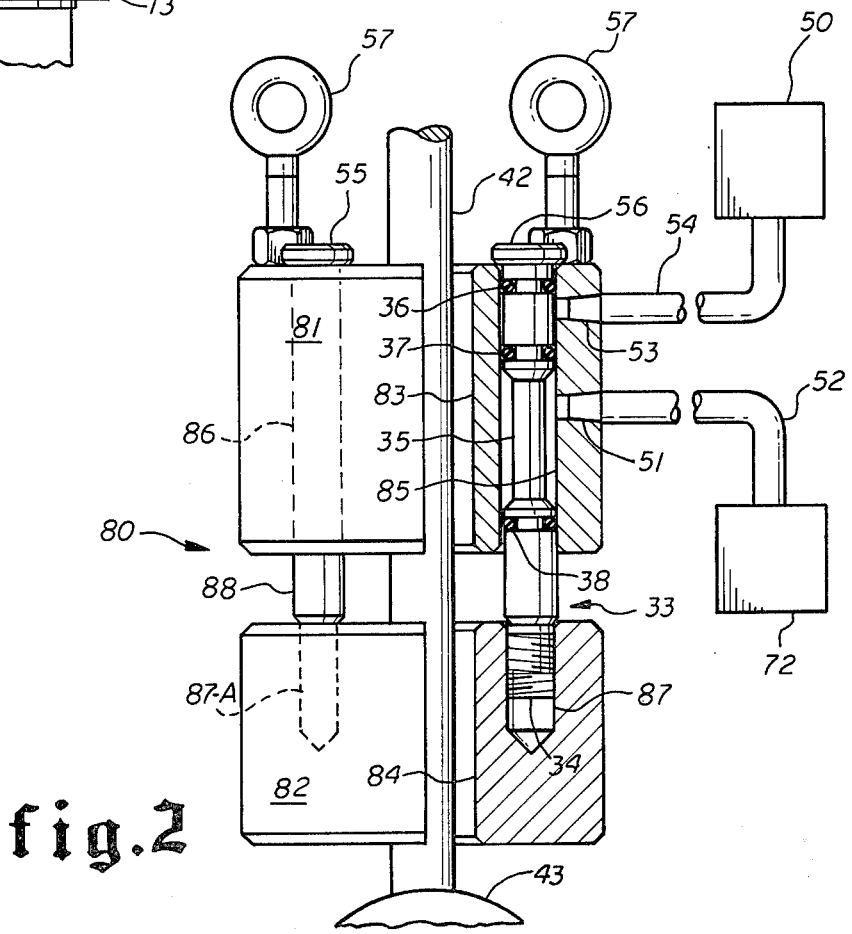
FIG. 2 is a, partly schematic, vertical quarter section through the line actuator of this invention.

Consider now the line actuator 80 of FIG. 2. Although the crane of FIG. 1 only depicts a single load line 42, there obviously may be a plurality of load lines, block lines, etc., each carrying a line actuator such as described hereafter. Such line actuator 80 includes upper and lower cylindrical body portions 81 and 82. Each such body portions 81, 82 have a central bore therethrough, namely 83 and 84 respectively. Upper body portion 81 includes a plurality (two being illustrated) of bores 85, 86 laterally spaced from central bore 83. Lower body portion 82 includes threaded tapped bores, such as 87, 87-A, for each of said laterally spaced, upper body portion bores 85,86. Loosely extending through upper body portion bore 86, and threadedly engaging tap 87-A by virtue of a threaded end (not shown) is guide pin 88. Likewise, valve body 33 has one end 34 threadedly engaged with threaded tap 87 of lower body portion 82. The upper extremity of valve body 33 slidably extends through bore 85 of the upper valve body portion 81. O-ring seals 36, 37 and 38 surround stem 35 and sealingly engage the walls of bore 85. Supply inlet 51 communicates with bore 85 and receives fluid under pressure through conduit 52 from source 72. Also, pressure outlet 53 communicates with bore 85, and is in communication with signalling device 50 through conduit 54. Heads 55 and 56 at one end of guide pin 88 and valve body 33 limit downward movement. Eyebolts 57 threadedly engage and extend upwardly from upper body portion 81. Lines or cables such as 101 (see FIG. 1) would secure such eyebolts, and thereby boom actuator 80 to the end of boom 30 opposite its pivotal juncture 13 to cab 11. As illustrated, load line 42 extends through bores 83, 84 and carries ball 43 and hook 44 at its lower extremity, for load engagement.

In explaining the operation of boom actuator 80, it should be noted that upper and lower body portions 81, 82 are normally spaced apart. In such a relationship, seal 37 prevents fluid communication between source 72 and horn 50 through inlet and outlets 51 and 53. However, inasmuch as valve body 33 and guide pin 88 are slidable within respective bores 85,86, if line 42 is upwardly drawn sufficiently so that ball 43 (which may be referred to as a striker) impinges on and forces lower body portion 82 upwardly, valve body 33 moves upward such that then seal 37 passes by outlet 53, opening communication between pressure source 73 and horn 50 via bore 85, causing a signal to be emitted. When the load is then properly lowered, gravity will cause lower body portion 82 and therefore valve body 33 to return to the normal or blocking position of FIG. 2. It is thus seen that a unique warning system is provided which may be used on any number of lines as well as to indicate a dangerous boom position. Although a specific pneumatic circuit has not been described, the only requirement for purposes of this invention is that there need be (1) a source of pressure and communicating connections from said source to the inlet of each actuator, and (2) a signalling device and communicating connections from the outlet of each actuator to said pressure sensitive signalling device.

Although only a single embodiment has been described, it should be obvious that numerous modifications would be possible by one skilled in the art without departing from the spirit of the invention, the scope of which is limited only by the following claims.

I claim:

1. A warning system for use on a crane wherein said crane includes a movable boom, and at least one movable weight bearing line, said system comprising:

a. a source of fluid under pressure;

b. a pressure activated signal emitting device;

c. a plurality of signal device actuators positioned in substantially unrestricted pressure communication with said source and device;

d. each of said actuators having a housing and a valve body mounted in said housing for longitudinal movement therein and shiftable between a first position permitting pressure communication between said source and device and a second position blocking such communication, wherein one of said actuators further comprises:

i. first and second body portions, each including means for passing said line therethrough, one of said body portions providing said actuator's housing and the other of said body portions having a weight engageable portion; and ii. means for causing engagement between said weight and said weight engageable portion to shift said valve body to said first position.

2. A warning system for use on a crane wherein said crane includes a movable boom, and at least one movable weight bearing line, said system comprising:

a. a source of fluid under pressure;

b. a pressure activated signal emitting device;

c. a plurality of signal device actuators positioned in substantially unrestricted pressure communication with said source and device; and d. each of said actuators having a housing and a valve body mounted in said housing for longitudinal movement therein and shiftable between a first position permitting pressure communication between said source and device and a second position blocking said communication wherein one of said actuators further comprises:

i. a boom engageable portion of its valve body located outwardly of said housing;

ii. means internal to said housing for urging its valve body to said second position; and iii. means for causing said boom engageable portion to shift said valve body to said first position against the force of said urging means; and, wherein a second of said actuators further comprises:

iv. first and second body portions, each including means for passing said line therethrough, one of said body portions having a weight engageable portion; and v. means for causing engagement between said weight and said weight engageable portion to shift said second actuator's valve body to said first position.

3. A crane boom safety warning device for indicating a dangerous position of a weight bearing line, said device comprising:

a. first and second body portions, each of said body portions including means for passing said weight bearing line therethrough;

b. fluid pressure inlet means provided in said first body portion in fluid pressure communication with a fluid pressure source;

c. fluid pressure outlet means provided in said first body portion in fluid pressure communication with a fluid pressure activated signal emitter; and d. an elongated valve member mounted at least partially in said first body portion for longitudinal movement therein between a first portion permitting pressure communication between said inlet and outlet and a second portion blocking such communication.

4. The device of claim 3 further comprising means for permitting relative movement between said body portions.

5. The device of claim 4 wherein said means for permitting relative movement further comprises means for threadably engaging one end of said valve member to the second of said body portions.

6. The device of claim 6 further comprising means for causing engagement between said load and said second of said body portions to move said valve member to said first position.

7. The device of claim 6 further comprising means for causing said valve member to be positioned in said second position at all operative times in the absence of said engagement.

8. The device of claim 7 further comprising means for fixing said first of said body portions to the boom of said crane.

* * * * *

UNITED STATES PATENT AND TRADEMARK OFFICE

CERTIFICATE OF CORRECTION

PATENT NO. : 4,424,909

DATED : January 10, 1984

INVENTOR(S) : Ned A. Bergeron

It is certified that error appears in the above-identified patent and that said Letters Patent is hereby corrected as shown below:

Column 4, line 54, claim 6, "6" should read -- 5 --.

Signed and Sealed this

Second Day of April 1985

[SEAL]

*Attest:*

DONALD J. QUIGG

*Attesting Officer*

*Acting Commissioner of Patents and Trademarks*